US010066571B2

(12) United States Patent
Alrefaai et al.

(10) Patent No.: US 10,066,571 B2
(45) Date of Patent: Sep. 4, 2018

(54) METHODS AND SYSTEM FOR CENTRAL FUEL INJECTION

(71) Applicant: Ford Global Technologies, LLC, Dearborn, MI (US)

(72) Inventors: Kutaiba Alrefaai, Dearborn, MI (US); Adithya Pravarun Re Ranga, Canton, MI (US); Calvin Trescott, Farmington Hills, MI (US); Mohannad Hakeem, Dearborn, MI (US); Stephen B. Smith, Livonia, MI (US); Gopichandra Surnilla, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/409,322

(22) Filed: Jan. 18, 2017

(65) Prior Publication Data

US 2018/0202383 A1 Jul. 19, 2018

(51) Int. Cl.
*F02D 41/30* (2006.01)

(52) U.S. Cl.
CPC .. *F02D 41/3094* (2013.01); *F02D 2200/0414* (2013.01); *F02D 2200/0418* (2013.01)

(58) Field of Classification Search
CPC ..... F02D 41/30; F02D 41/3094; F02D 41/06; F02D 41/064; F02D 1/00; F02D 2200/0406; F02M 39/00; F02M 41/00; F02M 53/08
USPC ..... 123/295–299, 445, 478; 701/102–104, 701/109
See application file for complete search history.

(56) References Cited

U.S. PATENT DOCUMENTS

| | | | | |
|---|---|---|---|---|
| 1,413,804 | A | 4/1922 | Snyder | |
| 3,614,945 | A | 10/1971 | Schlagmueller et al. | |
| 5,408,972 | A | 4/1995 | Servati | |
| 5,690,087 | A | 11/1997 | Schumacher et al. | |
| 6,176,222 | B1 | 1/2001 | Kirwan et al. | |
| 7,426,918 | B2 | 9/2008 | Brehob et al. | |
| 2005/0193981 | A1* | 9/2005 | Sakai | F02D 41/3094 123/431 |
| 2011/0214644 | A1* | 9/2011 | Barta | F02M 37/04 123/512 |
| 2014/0102428 | A1* | 4/2014 | Fulton | F02B 29/0468 123/568.12 |
| 2016/0177813 | A1* | 6/2016 | Styles | F02B 29/0468 701/102 |

OTHER PUBLICATIONS

Hakeem, Mohannad, et al., "Methods and System for Adjusting Engine Operation Based on Evaporated and Condensed Portions of Water Injected at an Engine," U.S. Appl. No. 15/226,485, filed Aug. 2, 2016, 52 pages.

(Continued)

*Primary Examiner* — John Kwon
*Assistant Examiner* — Johnny H Hoang
(74) *Attorney, Agent, or Firm* — Julia Voutyras; McCoy Russell LLP

(57) ABSTRACT

Methods and systems are provided for leveraging the charge cooling effect of a manifold fuel injection. A charge cooling effect of a scheduled manifold fuel injection may be predicted based on feedback received from a manifold charge temperature sensor during a preceding manifold injection event. If sufficient charge cooling is not predicted, the manifold fuel injection is temporarily disabled.

20 Claims, 7 Drawing Sheets

(56) References Cited

OTHER PUBLICATIONS

Hakeem, Mohannad, et al., "Methods and System for Selecting a Location for Water Injection in an Engine," U.S. Appl. No. 15/226,548, filed Aug. 2, 2016, 52 pages.
Hakeem, Mohannad, et al., "Methods and System for Injecting Water at Different Groups of Cylinders of an Engine," U.S. Appl. No. 15/226,615, filed Aug. 2, 2016, 54 pages.

* cited by examiner

METHODS AND SYSTEM FOR CENTRAL FUEL INJECTION

FIELD

The present description relates generally to methods and systems for adjusting fueling into an engine intake manifold.

BACKGROUND/SUMMARY

Internal combustion engines may include central fuel injection (CFI) systems that inject fuel into an intake manifold. When fuel is injected into the engine intake, heat is transferred from the intake air and/or engine components to the fuel and this heat transfer leads to atomization of a portion of the fuel, which results in cooling of the engine components. Injecting fuel into the intake air (e.g., in the intake manifold, ports, etc.) lowers both the intake air temperature and a temperature of combustion at the engine cylinders. By cooling the intake air charge, a knock tendency may be decreased. This may also allow for a higher compression ratio, advanced ignition timing, and decreased exhaust temperature. Furthermore, lowered combustion temperature with fuel injection may reduce NOx, while a more efficient fuel mixture may reduce carbon monoxide and hydrocarbon emissions. In addition to CFI, fuel may be injected to intake runners via port injectors and/or directly into cylinders via direct injectors.

An example engine system with multiple fuel injectors is shown by Brehob et al. in U.S. Pat. No. 7,426,918. At the various locations of the injectors, there may be distinct fuel vaporization effects as well as fuel puddling effects. Accordingly, various approaches have been developed for adjusting the fueling schedule in engine systems having fuel injectors at different locations. In one example approach, as shown by Kirwan et al. in U.S. Pat. No. 6,176,222, the fueling schedule of each fuel injector is pre-emptively adjusted based on predicted fuel volatility, fuel vaporization effects, and expected fuel puddle dynamics. The prediction for manifold fuel injection is based on manifold conditions, such as manifold charge temperature, manifold air pressure, and engine speed.

However, the inventors herein have recognized potential issues with such systems. As one example, there may be a difference between the predicted amount of fuel atomization and puddle dynamics and the actual amount of fuel atomization and corresponding puddle dynamics following a fuel injection, due to transient engine conditions. In addition, fuel puddles formed at an intake manifold following manifold fuel injection may have an effect on port fuel puddles formed at an intake port. Further, an existing manifold fuel puddle may corrupt the predicted amount of vaporized fuel. As a result, the amount of fuel injected based on the prediction may not be sufficient for providing the desired level of cooling and for effective combustion. Inaccurate fueling may result in increased tendency for knock and the need for higher than intended spark retard usage, which in turn can cause an increase in fuel consumption. Further, based on the manifold conditions, such as based on how much fuel has vaporized into the manifold from an existing manifold fuel puddle, the charge cooling effect of the manifold fuel injection may vary. If the expected charge cooling is not provided, the manifold fuel injection may be rendered futile.

The inventors herein have identified an approach by which the issues described above may be at least partly addressed. One example method comprises: adjusting a ratio of fuel delivered to an engine via manifold injection relative to fuel delivered via one or more of port and direct injection based on a predicted charge cooling effect of the manifold injection, the charge cooling effect predicted based on each of a concentration of fuel vapor in the intake manifold, a temperature of a manifold surface onto which fuel is manifold injected, and air charge temperature. In this way, the fueling schedule may be adjusted based on predicted charge cooling including feedback from a manifold charge temperature (MCT) sensor, allowing fuel puddle dynamics to be more reliably accounted for.

As one example, based on engine operating conditions, an engine controller may determine an initial fuel injection profile including an amount of fuel to be delivered via manifold fuel injection (e.g., via a central manifold fuel injector or CFI), and a remaining amount of fuel to be delivered via one or more of port and direct fuel injection. As the fuel injected via the CFI atomizes in the intake manifold, the intake manifold may be cooled, creating a charge cooling effect. The controller may predict the charge cooling effect of the upcoming fuel injection event based on the temperature of a manifold surface onto which the fuel is injected via the CFI, and further based on a concentration of fuel vapor on the intake manifold (including fuel that has vaporized from a manifold fuel puddle). In one example, the charge cooling effect may be predicted based on a measured charge cooling effect of an immediately previous manifold fuel injection. For example, based on a change in manifold temperature from before and after the immediately previous manifold fuel injection, as measured by a manifold charge temperature sensor, the controller may estimate the amount of fuel that vaporized versus the amount of fuel that condensed in the manifold, and further estimate the change in manifold surface temperature. The controller may also update fuel puddle dynamics for a manifold fuel puddle accordingly. If the predicted charge cooling effect is more than a threshold amount, then the controller may fuel the engine in accordance with the determined fuel injection profile. Optionally, the manifold fuel injection amount may be updated with a correction factor based on the charge cooling learned on the previous manifold injection and a puddle correction factor based on the change in puddle size learned on the previous manifold injection. However, if the predicted charge cooling effect is less than the threshold amount, then in anticipation of insufficient charge cooling at the manifold, the fuel injection profile may be updated to decrease the manifold fuel injection amount. In one example, a direct fuel injection amount may be correspondingly increased so as provide a charge cooling effect in the cylinder.

In this way, by adjusting a manifold fuel injection based on a predicted charge cooling effect of the injection, the advantages of a manifold fuel injection may be better leveraged. By measuring a change in manifold temperature following a manifold fuel injection, an amount of fuel atomized versus an amount of fuel remaining in the liquid phase, following a manifold injection, may be accurately estimated. This enables size and dynamics of a manifold fuel puddle generated after each injection to be accurately determined. The technical effect of accurately estimating the amount of fuel atomized, the amount of fuel condensed, and the corresponding puddle dynamics is that subsequent fueling schedule may be effectively adjusted to provide a desired level of manifold cooling. By providing manifold cooling, engine performance and fuel efficiency may be improved.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 5:
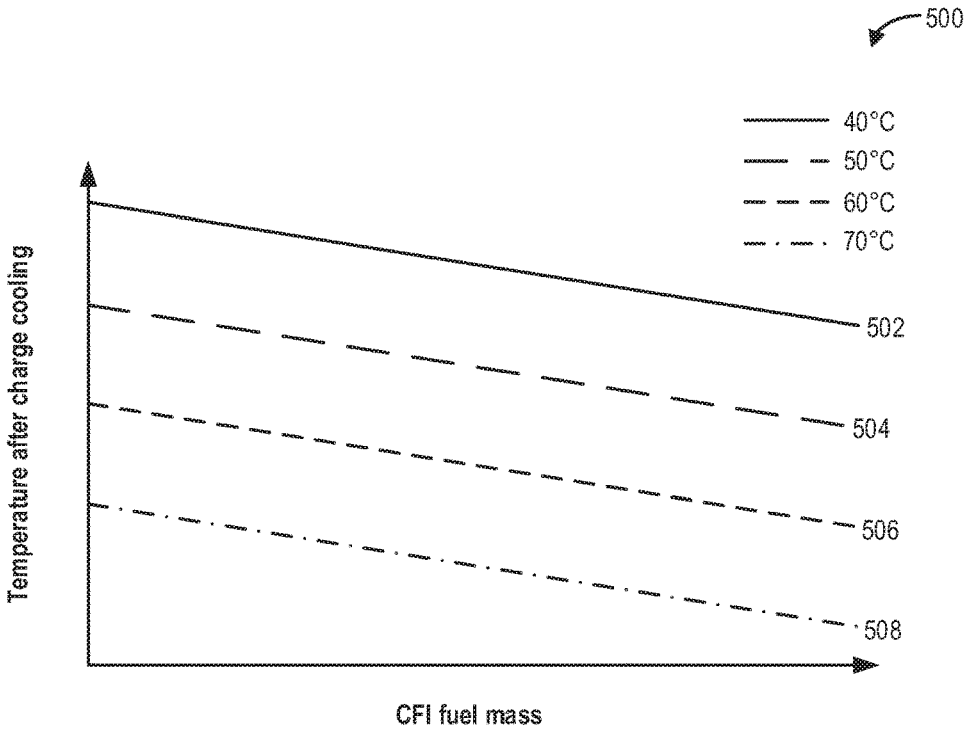
FIG. 5 shows an example plot illustrating charge air cooling following manifold fuel injection.
Figure 6:
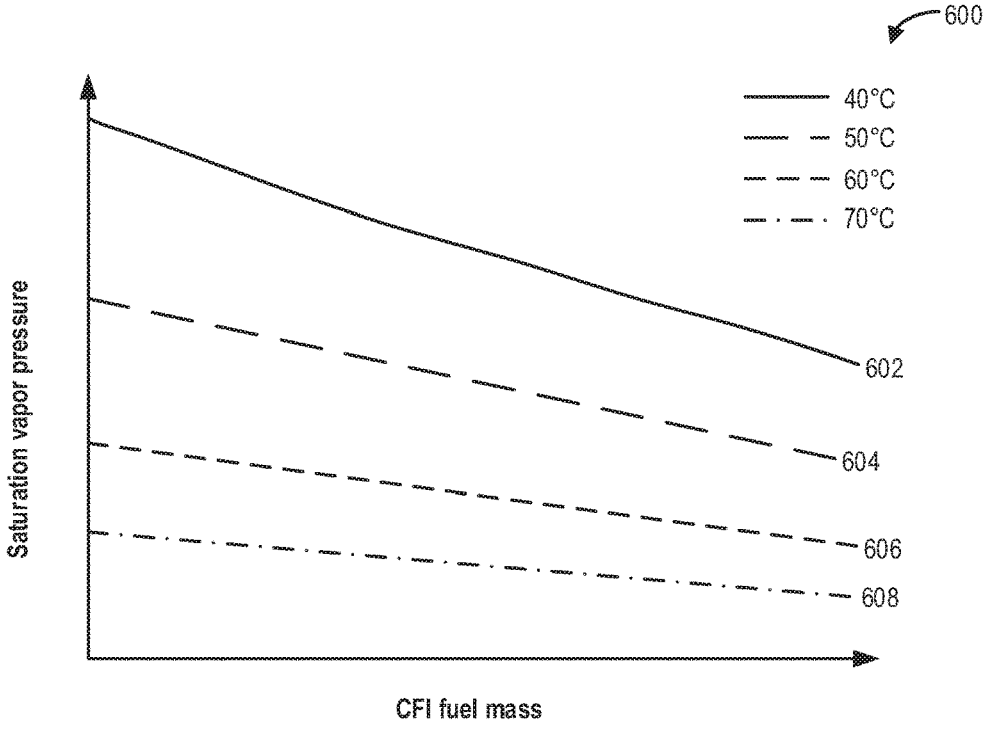
FIG. 6 shows an example plot illustrating change in saturation vapor pressure with manifold fuel injection.
Figure 7:
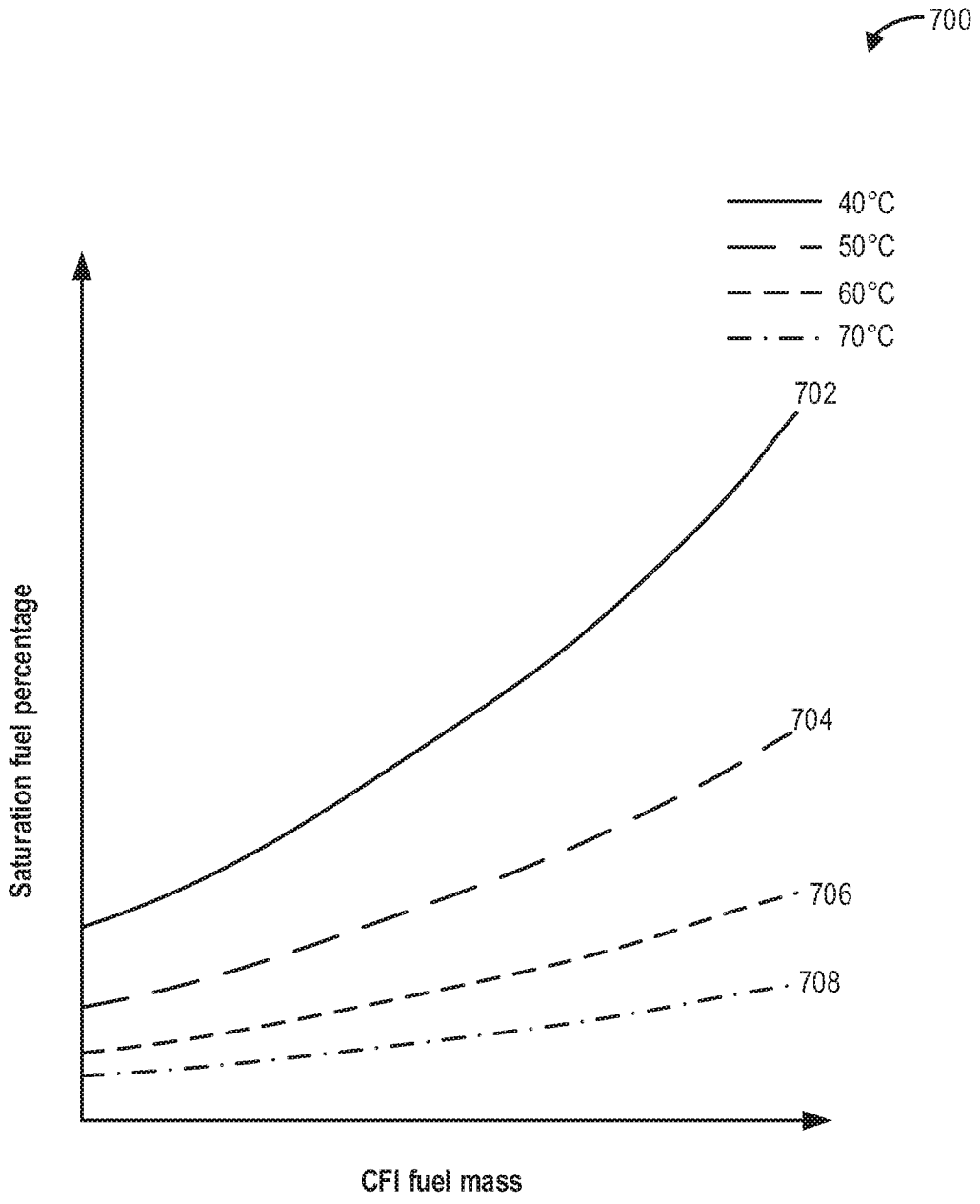
FIG. 7 shows an example plot illustrating change in saturation fuel percentage with manifold fuel injection.
Figure 8:
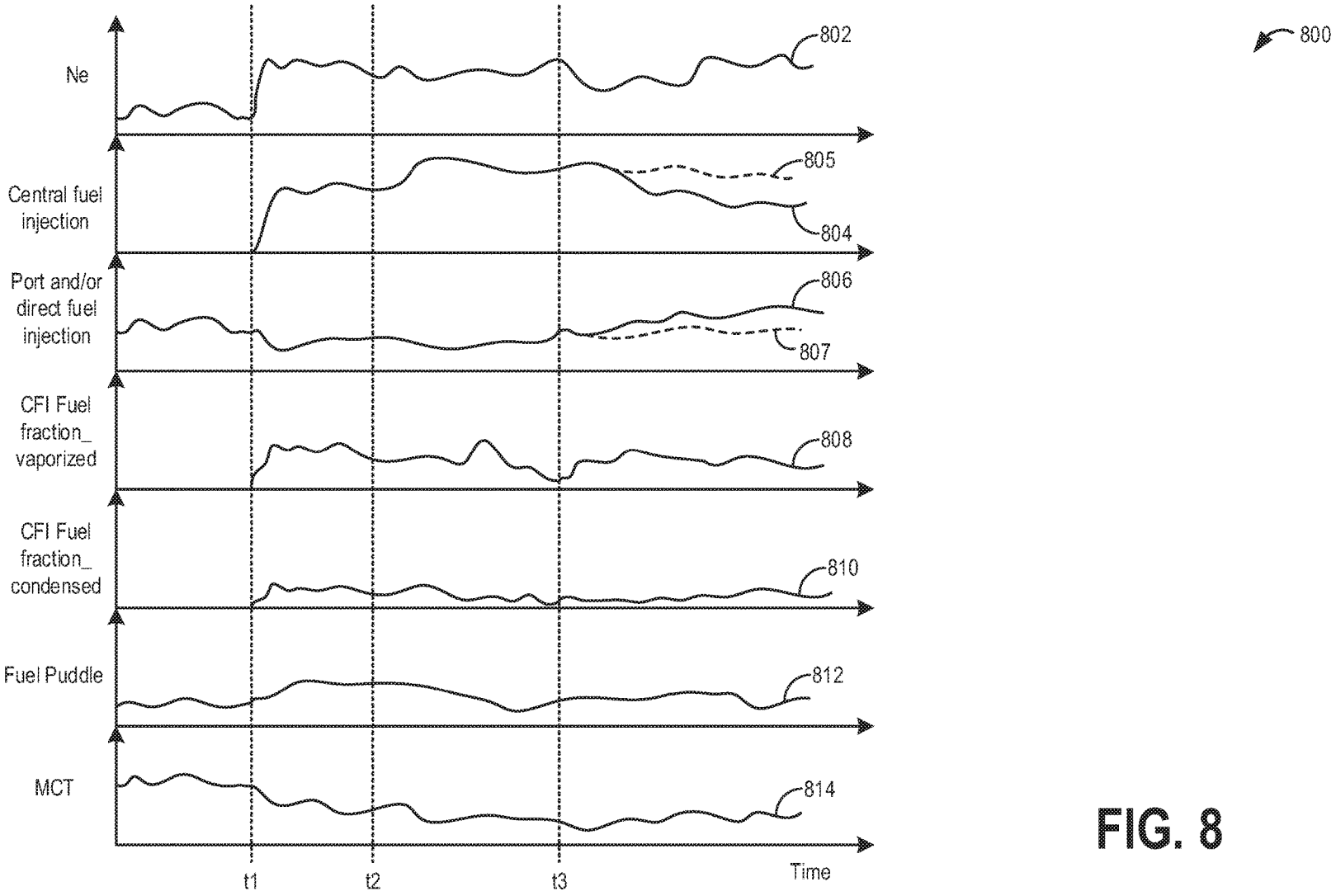
FIG. 8 shows example adjustments to a fuel injection schedule, including a manifold fuel injection amount, based on a charge cooling effect.

The following description relates to systems and methods for predicting a charge cooling effect of a planned manifold fuel injection, estimating updates to manifold fuel puddle dynamics, and adjusting a fueling schedule based on feedback from a manifold charge temperature sensor. The systems and methods may be applied to an engine system having manifold, direct, and port fuel injection capabilities, such as the engine system of FIG. 1. An engine controller may refer a map, such as the example map of FIG. 2, to identify regions of engine operation where manifold fuel injection can be leveraged for improving engine efficiency. The engine controller may be configured to perform a control routine, such as the example routine of FIG. 3, to predict a charge cooling effect of a fuel injection profile, including an amount of fuel to be manifold injected, and adjust the fuel injection profile if the predict charge cooling effect is insufficient. The engine controller may also be configured to adjust the fueling schedule based on manifold fuel puddle dynamics and manifold charge temperature, as shown in the example routine of FIG. 4. FIGS. 5-7 show how a manifold fuel injection can be used to leverage changes in charge temperature, saturation vapor pressure, and saturation fuel percentage. An example of fuel schedule adjustment is shown at FIG. 8. In this way, the benefits of a manifold fuel injection can be extended.

Figure 1:
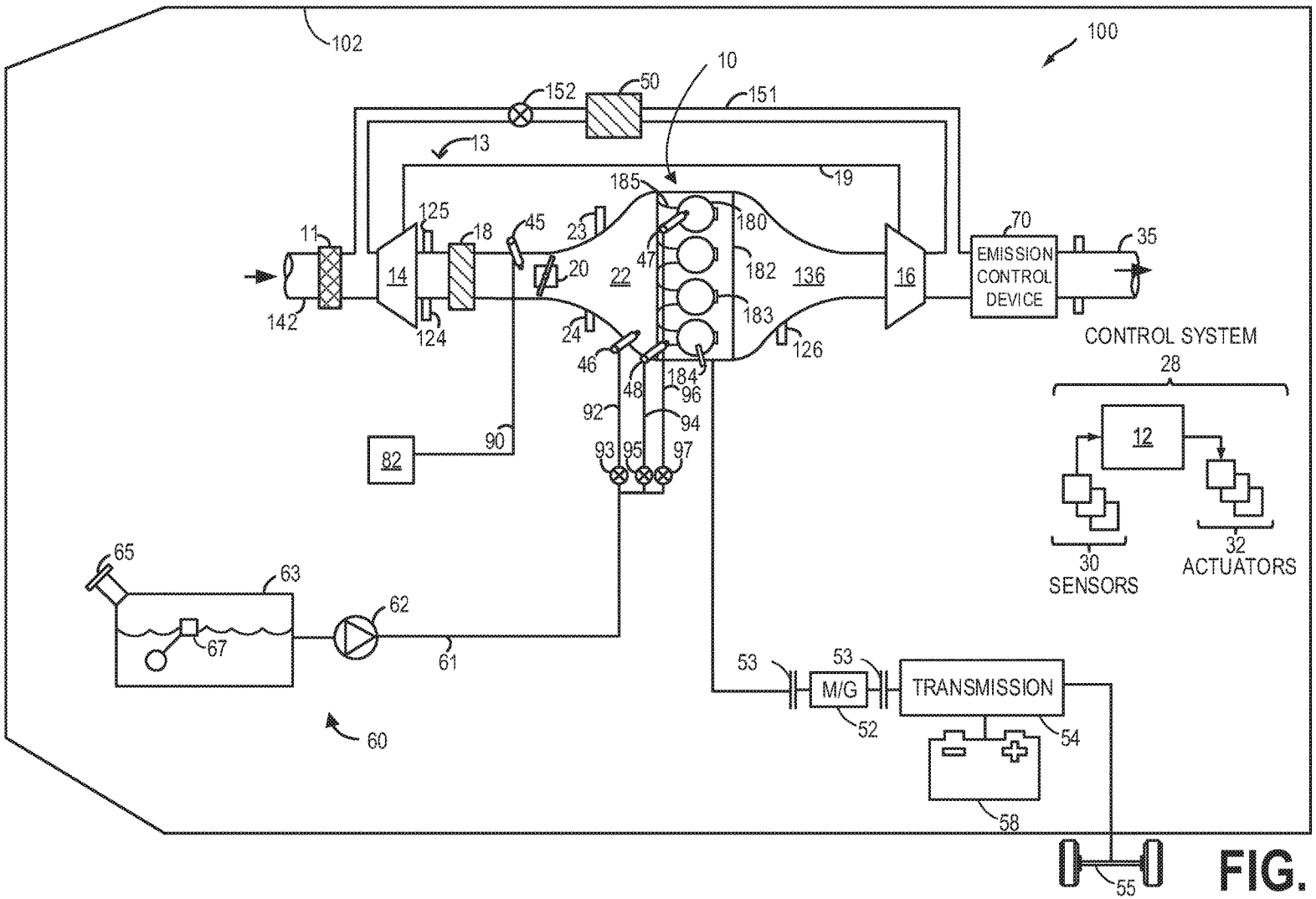
FIG. 1 shows an example embodiment of an engine system configured with manifold, direct, and port fuel injection capabilities.

FIG. 1 shows an embodiment of an engine system 100 in a motor vehicle 102, illustrated schematically. In the depicted embodiment, engine 10 is a boosted engine coupled to a turbocharger 13 including a compressor 14 driven by a turbine 16. Specifically, fresh air is introduced along intake passage 142 into engine 10 via air cleaner 11 and flows to compressor 14. The compressor may be a suitable intake-air compressor, such as a motor-driven or driveshaft driven supercharger compressor. In the engine system 100, the compressor is shown as a turbocharger compressor mechanically coupled to turbine 16 via a shaft 19, the turbine 16 driven by expanding engine exhaust. In one embodiment, the compressor and turbine may be coupled within a twin scroll turbocharger. In another embodiment, the turbocharger may be a variable geometry turbocharger (VGT), where turbine geometry is actively varied as a function of engine speed and other operating conditions.

As shown in FIG. 1, compressor 14 is coupled, through charge air cooler (CAC) 18 to throttle valve (e.g., intake throttle) 20. The CAC may be an air-to-air or air-to-coolant heat exchanger, for example. Throttle valve 20 is coupled to engine intake manifold 22. From the compressor 14, the hot compressed air charge enters the inlet of the CAC 18, cools as it travels through the CAC, and then exits to pass through the throttle valve 20 to the intake manifold 22. In the embodiment shown in FIG. 1, the pressure of the air charge within the intake manifold is sensed by manifold air pressure (MAP) sensor 24 and a boost pressure is sensed by boost pressure sensor 124. A compressor by-pass valve (not shown) may be coupled in series between the inlet and the outlet of compressor 14. The compressor by-pass valve may be a normally closed valve configured to open under selected operating conditions to relieve excess boost pressure. For example, the compressor by-pass valve may be opened during conditions of decreasing engine speed to avert compressor surge.

Intake manifold 22 is coupled to a series of combustion chambers or cylinders 180 through a series of intake valves (not shown) and intake runners (e.g., intake ports) 185. As shown in FIG. 1, the intake manifold 22 is arranged upstream of all combustion chambers 180 of engine 10. Sensors such as manifold charge temperature (MCT) sensor 23 and air charge temperature sensor (ACT) 125 may be included to determine the temperature of intake air at the respective locations in the intake passage. In some examples, the MCT and the ACT sensors may be thermistors and the output of the thermistors may be used to determine the intake air temperature in the passage 142. The MCT sensor 23 may be positioned between the throttle 20 and the intake valves of the combustion chambers 180. The ACT sensor 125 may be located upstream of the CAC 18 as shown, however, in alternate embodiments, the ACT sensor 125 may be positioned upstream of compressor 14. The air temperature may be further used in conjunction with an engine coolant temperature to compute the amount of fuel that is delivered to the engine, for example. Each combustion chamber may further include a knock sensor 183. The combustion chambers are further coupled to exhaust manifold 136 via a series of exhaust valves (not shown).

Engine system 100 is coupled to a fuel system 60. Fuel system 60 includes a fuel tank 63 coupled to a fuel pump 62, the fuel tank supplying fuel to an engine 10 which propels a vehicle. During a fuel tank refueling event, fuel may be pumped into the vehicle from an external source through refueling port 65. Fuel tank 63 may hold a plurality of fuel blends, including fuel with a range of alcohol concentrations, such as various gasoline-ethanol blends, including E10, E85, gasoline, etc., and combinations thereof. A fuel level sensor 67 located in fuel tank 63 may provide an indication of the fuel level ("Fuel Level Input") to the controller 12. As depicted, fuel level sensor 67 may comprise a float connected to a variable resistor. Alternatively, other types of fuel level sensors may be used. Fuel pump 221 is configured to pressurize fuel delivered to a plurality of injectors of engine 10, such as example injectors 46-48.

The combustion chambers 180 are capped by cylinder head 182 and coupled to a first direct fuel injector (DI) 47 which injects fuel directly into one or more combustion chambers 180. A second port fuel injector (PFI) 48 is arranged in the intake runners for injecting fuel directly onto the intake valve. In one example, the injector 48 may be angled toward and facing the intake valve of the cylinder which the intake runner is attached to, causing fuel to be injected in the same direction as intake airflow into the cylinder. In another embodiment, injector 48 may be angled away from the intake valve and may be arranged to inject fuel against the intake air flow direction through the intake runner. Though only one representative injector 47 and injector 48 are shown in FIG. 1, each combustion chamber 180 and intake runner 185 may include its own injector. A third central fuel injector (CFI) 46, herein also referred to as a manifold fuel injector, may be coupled to the engine intake manifold 22 downstream of the throttle 20 to inject fuel directly to the intake manifold. For example, the manifold fuel injector 46 may inject fuel onto a surface of the intake manifold.

In embodiments that include multiple fuel injectors, fuel delivery passage 61 may contain one or more valves to select between different fuel injectors. For example, as shown in FIG. 1, fuel stored in fuel tank 63 is delivered to fuel injectors 46-48 via a common fuel delivery passage 61 that branches to fuel passages 92, 94, and 96. In the depicted embodiment, fuel from fuel passage 61 may be diverted through one or more of valve 93 and passage 92 to deliver fuel to CFI 46, through valve 95 and passage 94 to deliver fuel to PFI 48, and/or through valve 97 and passage 96 to deliver fuel to DI 47.

When fuel is injected into the engine intake, heat is transferred from the intake air and/or engine components to the fuel and this heat transfer leads to atomization of a portion of the fuel, which results in cooling of the engine components. The same effect also occurs when fuel is directly injected into a cylinder wherein heat is drawn in from the cylinder charge, cylinder walls, and cylinder surface. Based on engine operating conditions, engine dilution demands, and engine cooling demands, fuel may be injected through one or more of the DI, PFI, and the CFI. Based on the fuel split between the injectors (amount of fuel delivered via each injector), the valves 93, 95, and 97 may be adjusted to route fuel through one or more fuel lines 92, 94, and 96. In one example, responsive to higher engine intake manifold cooling demands, a higher portion of the total fuel injection may be delivered via CFI 46 and a remaining portion of the total fuel may be delivered via one or more of PFI 48 and DI 47. The higher volume of fuel may be injected via CFI 46 by increasing the opening of valve 93 while correspondingly decreasing the openings of valves 95 (to provide a lower volume of PFI injected fuel) and/or valve 97 (to provide a lower volume of DI injected fuel).

Based on manifold conditions at the time of the manifold injection, a portion of the manifold injected fuel may vaporize while a remaining volume of the manifold injected fuel may condense in the manifold, forming a fuel puddle in the intake manifold. As engine operating conditions change and manifold injection conditions change from injection event to injection event, the size of the fuel puddle may change dynamically. For example, during higher engine load conditions when there is a larger air flow through the manifold, as well as conditions when the manifold surface temperature and/or ambient temperature is higher, there may be a decrease in the puddle size due to more vaporization of fuel from the fuel puddle. As another example, during lower engine load conditions when there is a smaller air flow through the manifold, as well as conditions when the manifold surface temperature and/or ambient temperature is lower, there may be an increase in the puddle size due to less vaporization of fuel from the fuel puddle. Further still, fuel puddle size may change due to fuel leaking from the manifold injector, fuel being improperly released from the manifold injector, etc. Since the charge cooling effect of the manifold injection is realized by virtue of the rapid atomization of the injected fuel, an engine controller may be able to learn a charge cooling effect produced on a given manifold injection event based on a change in manifold charge temperature following the manifold injection. In one example, a manifold charge temperature sensed via MCT sensor 23 before fuel injection via CFI 46 may be compared to a manifold charge temperature sensed via MCT sensor 23 after fuel injection via CFI 46. A charge cooling effect actually realized may then be determined as a function of the difference between the sensed manifold charge temperatures. This may correspond to the portion of the manifold injected fuel that vaporized. By comparing the vaporized amount to the total manifold injection amount, an amount of manifold injected fuel that condensed in the manifold may be calculated. Manifold fuel puddle dynamics and estimates can then be updated based on the learned fraction of condensed fuel. For example, a fuel puddle correction factor may be updated based on the amount of manifold injected fuel that did not vaporize (and therefore contributed to the fuel puddle). In addition, since the amount of fuel that vaporizes from the fuel puddle varies as a function of the fuel vapor concentration in the manifold, the fuel puddle correction factor may also be updated based on the amount of manifold injected fuel that did vaporize. The charge cooling effect may also be used to update a charge cooling correction factor.

Subsequent manifold fuel injections may then be updated using each of the fuel puddle correction factor and the charge cooling correction factor. Furthermore, the charge cooling effect and puddle dynamics of a current manifold fuel injection can be used to predict the charge cooling effect of a subsequent manifold fuel injection. As elaborated at FIG. 3, a controller may determine an initial fuel injection profile including a manifold fuel injection amount, and then predict a charge cooling effect for the injection. If insufficient charge cooling is predicted, then the initial fuel injection profile may be adjusted to decrease the manifold fuel injection amount.

Combustion chamber 180 may also draw in water and/or water vapor, which may be injected into the engine intake or the combustion chambers 180 themselves by one or more water injectors. In the depicted embodiment, a water injection system is configured to inject water upstream of the throttle 20 via water injector 45. In an alternate embodiment, water injectors may be included downstream of the throttle, in intake runners (e.g., ports), and directly in one or more combustion chambers. As an example, each combustion chamber 180 and intake runner 185 may include its own injector. Water may be delivered to each of the injector from a water tank 82 via a water line 90.

In the depicted embodiment, a single exhaust manifold 136 is shown. However, in other embodiments, the exhaust manifold may include a plurality of exhaust manifold sections. Configurations having a plurality of exhaust manifold sections may enable effluent from different combustion chambers to be directed to different locations in the engine system. Universal Exhaust Gas Oxygen (UEGO) sensor 126 is shown coupled to exhaust manifold 136 upstream of turbine 16. Alternatively, a two-state exhaust gas oxygen sensor may be substituted for UEGO sensor 126.

As shown in FIG. 1, exhaust from the one or more exhaust manifold sections is directed to turbine 16 to drive the turbine. When reduced turbine torque is desired, some exhaust may be directed instead through a waste gate (not shown), by-passing the turbine. The combined flow from the turbine and the waste gate then flows through one or more emission control devices 70. The one or more emission control devices 70 may include one or more exhaust after-treatment catalysts configured to catalytically treat the exhaust flow and reduce an amount of one or more substances in the exhaust flow, such as a NOx trap, oxidation catalysts, reduction catalysts, etc.

All or part of the treated exhaust from emission control device 70 may be released into the atmosphere via exhaust conduit 35. Depending on operating conditions, however, some exhaust may be diverted instead to an exhaust gas recirculation (EGR) passage 151, through EGR cooler 50 and EGR valve 152, to the inlet of compressor 14. In this manner, the compressor is configured to admit exhaust tapped from downstream of turbine 16. The EGR valve 152 may be opened to admit a controlled amount of cooled exhaust gas to the compressor inlet for desirable combustion and emissions-control performance. In this way, engine system 100 is adapted to provide external, low-pressure (LP) EGR. The rotation of the compressor, in addition to the relatively long LP EGR flow path in engine system 100, provides excellent homogenization of the exhaust gas into the intake air charge. Further, the disposition of EGR take-off and mixing points provides effective cooling of the exhaust gas for increased available EGR mass and increased performance. In other embodiments, the EGR system may be a high pressure EGR system with EGR passage 151 connecting from upstream of the turbine 16 to downstream of the compressor 14. In some embodiments, the MCT sensor 23 may be positioned to determine the manifold charge temperature, and may include air and exhaust recirculated through the EGR passage 151.

FIG. 1 further shows a control system 28. Control system 28 may be communicatively coupled to various components of engine system 100 to carry out the control routines and actions described herein. For example, as shown in FIG. 1, control system 28 may include an electronic digital controller 12. Controller 12 may be a microcomputer, including a microprocessor unit, input/output ports, an electronic storage medium for executable programs and calibration values, random access memory, keep alive memory, and a data bus. As depicted, controller 12 may receive input from a plurality of sensors 30, which may include user inputs and/or sensors (such as transmission gear position, gas pedal input (e.g., pedal position), brake input, transmission selector position, vehicle speed, engine speed, mass airflow through the engine, boost pressure, ambient temperature, ambient humidity, intake air temperature, fan speed, etc.), cooling system sensors (such as ECT sensor, fan speed, passenger compartment temperature, ambient humidity, etc.), intake manifold sensors such as MCT sensor 23, MAP sensor 24, CAC 18 sensors such as CAC inlet air temperature, ACT sensor 125 and pressure, CAC outlet air temperature, and pressure, etc., knock sensors 183 for determining ignition of end gases and/or water distribution among cylinders, and others. Furthermore, controller 12 may communicate with various actuators 32, which may include engine actuators such as fuel injectors 46-48, an electronically controlled intake air throttle 20, spark plugs 184, water injector 45, etc. In some examples, the storage medium may be programmed with computer readable data representing instructions executable by the processor for performing the methods described below as well as other variants that are anticipated but not specifically listed.

The controller 12 receives signals from the various sensors of FIG. 1 and employs the various actuators of FIG. 1 to adjust engine operation based on the received signals and instructions stored on a memory of the controller. In one example, based on engine load, the controller may send a pulse-width signal to manifold fuel injector 46 to inject an amount of fuel into the intake manifold. As another example, based on inputs from MCT sensor 23 received immediately before and after fuel injection via manifold injector 46, the controller may estimate a fraction of the injected fuel that atomized relative to the fraction of fuel that condensed to form a fuel puddle in the intake manifold. In another example, the controller may estimate intake manifold temperature based on inputs from the MCT sensor 23 and in response to a higher than threshold manifold cooling demands may send a signal to the actuators of injector 45 to inject water to the intake manifold to provide a charge cooling effect.

In some examples, vehicle 102 may be a hybrid vehicle with multiple sources of torque available to one or more vehicle wheels 55. In other examples, vehicle 102 is a conventional vehicle with only an engine, or an electric vehicle with only electric machine(s). In the example shown, vehicle 102 includes engine 10 and an electric machine 52. Electric machine 52 may be a motor or a motor/generator. Engine 10 and electric machine 52 are connected via a transmission 54 to vehicle wheels 55 when one or more clutches 53 are engaged. In the depicted example, a first clutch 53 is provided between engine 10 and electric machine 52, and a second clutch 53 is provided between electric machine 52 and transmission 54. Controller 12 may send a signal to an actuator of each clutch 53 to engage or disengage the clutch, so as to connect or disconnect engine 10 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle. Electric machine 52 receives electrical power from a traction battery 58 to provide torque to vehicle wheels 55. Electric machine 52 may also be operated as a generator to provide electrical power to charge battery 58, for example during a braking operation.

In this way, the components of FIG. 1 enable an engine system comprising a manifold injector for injecting fuel into an intake manifold; a port injector for injecting fuel into an intake port; a direct injector for injecting fuel directly into an engine cylinder; a temperature sensor coupled to the intake manifold, and a controller. The controller may be configured with computer readable instructions for: following a first fuel injection event including manifold fuel injection, updating each of a fuel puddle correction factor and a charge cooling correction factor based on an amount of fuel vaporized, the amount of fuel vaporized based on a change in manifold temperature following the manifold fuel injection; and during a second fuel injection event immediately following the first fuel injection event, estimating an initial fuel injection ratio including manifold fuel injection and one or more of the port and direct fuel injection; predicting a charge cooling effect of the manifold fuel injection based on each of a concentration of fuel vapor in the intake manifold and a temperature of a manifold surface; and if the predicted charge cooling effect is higher than a threshold, updating the initial fuel injection ratio to increase the manifold fuel injection as a function of each of the fuel puddle correction factor and charge cooling correction factor, and injecting fuel according to the updated fuel injection ratio. Additionally or optionally, the updating may further include decreasing one or more of the port and direct fuel injection based on the increase in manifold fuel injection to maintain exhaust air-fuel ratio at a target ratio. Additionally or optionally, the controller may include further instructions for updating the initial fuel injection ratio to decrease the manifold fuel injection if the predicted charge cooling effect is lower than the threshold. Additionally or optionally, the concentration of fuel vapor in the intake manifold may be estimated based on the fuel puddle correction factor, wherein the temperature of the manifold surface is estimated based on the charge cooling correction factor, and wherein the predicted charge cooling effect is increased as the concentration of fuel vapor in the intake manifold decreases and the temperature of the manifold surface increases.

Figure 2:
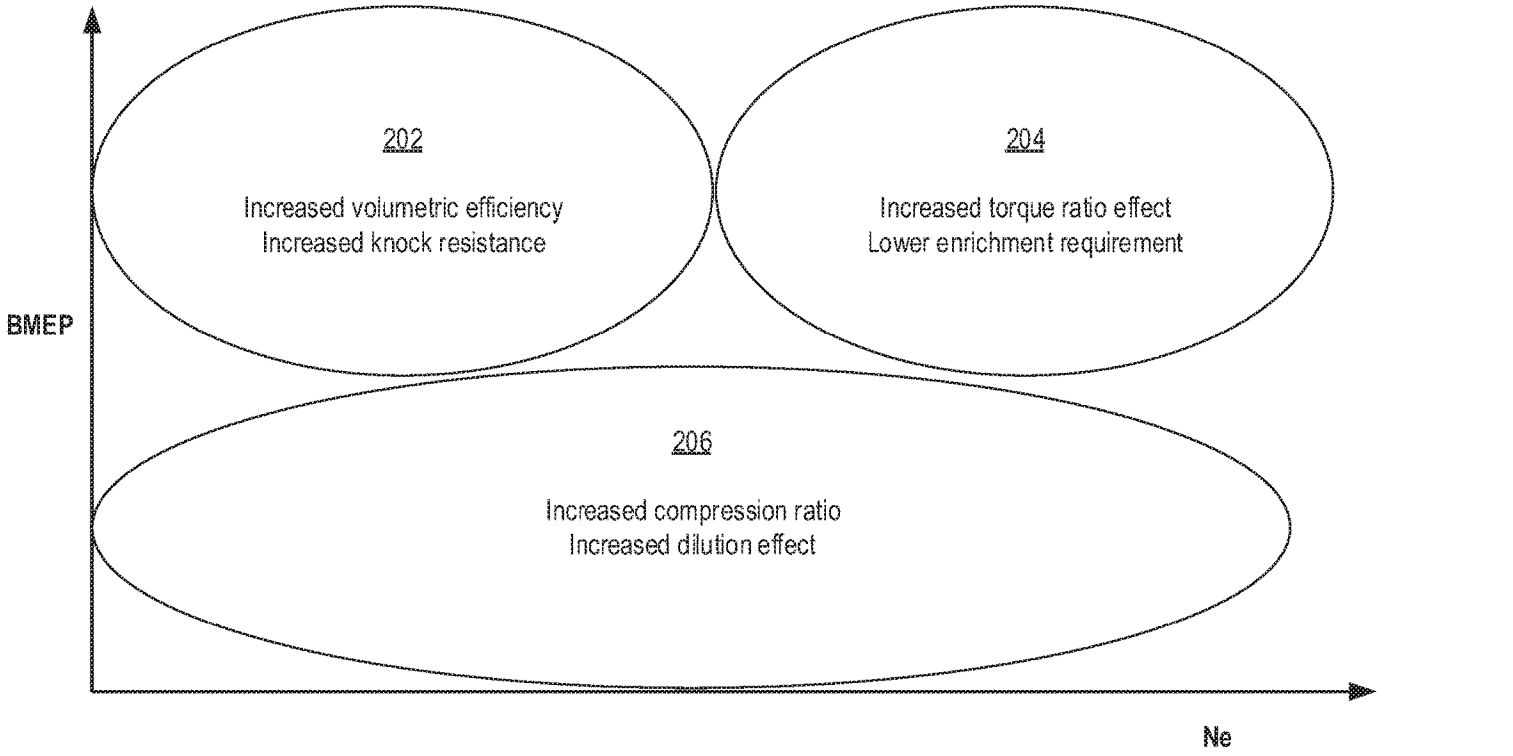
FIG. 2 shows an example map of manifold fuel injection benefits as a function of engine speed-load regions.

FIG. 2 depicts an example map 200 of the different benefits of manifold fuel injection via a central fuel injector (CFI) in different engine operating regions. The x-axis denotes engine speed (Ne) and the y-axis denotes brake mean effective pressure (BMEP) which correspond to engine load.

In high load and low speed engine operating regions, denoted by region 202, fuel injection via CFI provides a torque output benefit by increasing the volumetric efficiency. In addition, knock resistance is increased due to an advancement in the combustion phasing (that is, advanced CA50). In high load and high speed engine operating regions, denoted by region 204, fuel injection via CFI provides a torque output benefit due to an advancing of borderline spark limit (BDL) as well as an advance in the combustion phasing (that is, advanced CA50). This results in an enhanced torque ratio. In addition, the fuel injection reduces the turbine inlet temperature, thereby reducing the requirement for fuel enrichment (for knock control). In low load engine operating regions, denoted by region 206, fuel injection via CFI improves the thermal efficiency by enabling the engine design to tolerate a higher compression ratio.

In addition to the region-specific benefits listed above, at any given output torque, fuel injection to the intake manifold via CFI can reduce the intake charge temperature resulting in a lower MAP and improved thermal efficiency through better combustion phasing (more advanced borderline spark). The improvement in thermal efficiency reduces the required air flow. Since the turbocharger speed is a function of both the pressure ratio and mass flow, reducing the MAP reduces the mass flow, and thereby the turbocharger speed, lowering the pressure ratio across the compressor. The lower pressure ratio reduces the compressor outlet temperature, extending the life of the compressor. Further, the lower compressor outlet temperature reduces the engine's pumping work (due to the engine operating with a more open wastegate, and requiring less turbine power). In addition to knock, each of turbocharger speed, compressor outlet temperature, peak cylinder pressure, and turbine inlet temperature can limit the peak power of a turbocharged engine. Consequently, for a given pressure ratio, by leveraging fuel injection, the output torque becomes higher.

As such, the map of FIG. 2 describes the general benefits of injecting fuel via CFI. It will be appreciated that distinct fuel injection benefits may be similarly leveraged by adjusting a location of fuel injection. For example, manifold fuel injection may provide dilution benefits at low load, and charge cooling benefits at high load. As another example, direct fuel injection may provide charge cooling benefits at all loads. As still a further example, port fuel injection may provide charge cooling benefits based on the direction of fuel injection (e.g., towards or away from an intake valve) as well as a timing of the injection in relation to intake valve timing (e.g., when the intake valve is open or closed). As such, similar benefits (as described herein) may be achieved by opportunistically injecting water to one or more locations in the engine such as manifold water injection, direct water injection, and port water injection. However, compared to the availability of fuel (fuel being always available for engine operation), water may not be always available in the engine system. Therefore, the above mentioned benefits may be achieved by injecting fuel via one or more of the CFI, the DI, and the PFI.

Figure 3:
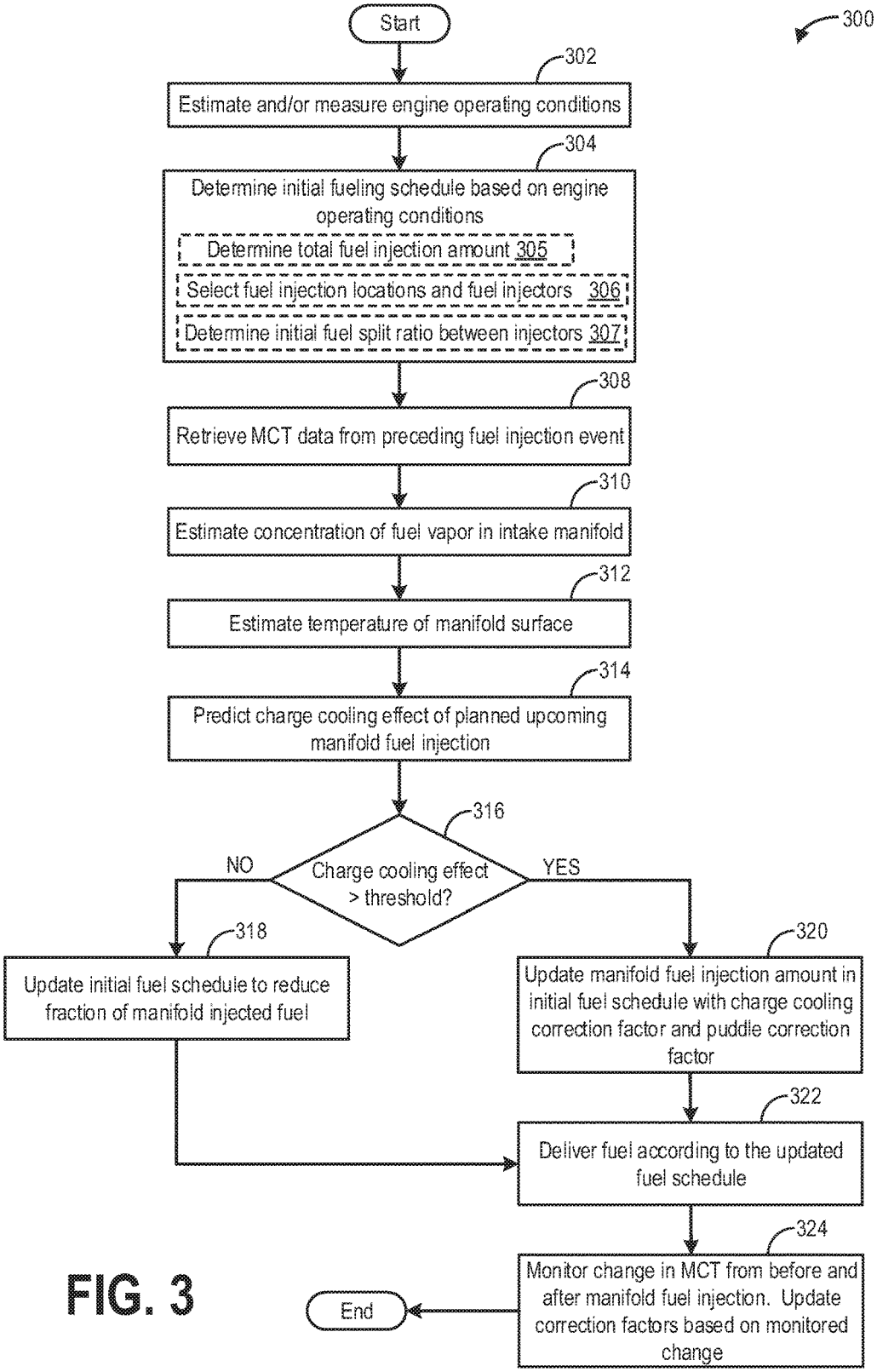
FIG. 3 shows a flow chart illustrating an example method for adjusting a fuel injection schedule based on a predicted charge cooling effect of a manifold fuel injection.

FIG. 3 illustrates an example method 300 that may be implemented for adjusting a ratio of fuel delivered to an engine via manifold injection relative to port and/or direct injection based on a predicted charge cooling effect of the manifold injection. Instructions for carrying out method 300 and the rest of the methods included herein may be executed by a controller based on instructions stored on a memory of the controller and in conjunction with signals received from sensors of the engine system, such as the sensors described above with reference to FIG. 1. The controller may employ engine actuators of the engine system to adjust engine operation, according to the methods described below.

At 302, the routine includes estimating and/or measuring engine operating conditions. Conditions assessed may include, for example, driver demand, engine temperature, engine load, engine speed, manifold charge temperature, exhaust temperature, ambient conditions including ambient temperature, pressure, and humidity, manifold pressure and air flow, boost pressure, exhaust air/fuel ratio, EGR flow, etc.

At 304, an initial fueling schedule may be determined based on the engine operating conditions. For example, based on the torque demand, an engine dilution demand and engine cooling demand may be determined, and a fueling schedule may be determined that meets the torque demand while also meeting the engine dilution demand and cooling demand. The fueling schedule may be further based on the transient fuel compensation history of the cylinders. Determining the initial fueling includes, at 305, determining a total amount of fuel to be injected into the engine to meet the torque demand. As the torque demand increases, the total amount of fuel to be injected may be increased. In one example, the controller may use a look-up table to determine the amount of fuel to be injected. A plurality of engine operating conditions such as engine speed, engine load, and torque demand may be used as input and the total amount of fuel to be injected may be the output. As another example, the controller may make a logical determination regarding a total amount of fuel to be injected based on logic rules that are a function of engine speed, engine load, and torque demand. The total amount of fuel to be injected may include fuel to be injected via one or more of a direct injector (such as DI 47 of FIG. 1), a port injector (such as PFI 48 of FIG. 1), and a central fuel injector (such as CFI 46 of FIG. 1). The controller may generate pulse-width signals that are sent to the one or more fuel injectors.

Determining the initial fueling further includes, at 306, selecting one or more fuel injection locations, and corresponding fuel injectors for injecting at least a portion of the total fuel. Fuel injection at the different locations provide distinct benefits. For example, manifold fuel injection may provide charge cooling in the intake manifold as fuel is vaporized by absorbing heat from the intake manifold. In addition, manifold fuel injection may effectively reduce pumping losses. As another example, port fuel injection may provide engine dilution when fuel is injected onto (and towards) a hot surface of a closed intake valve. Therein, the rapid evaporation of fuel may be advantageously used to maximize charge dilution effects of the fuel injection while minimizing charge cooling effects. As yet another example, port fuel injection may provide charge cooling when fuel is injected onto away from an open intake valve. Therein, the improved mixing of the injected water with the oncoming air flow may be advantageously used to maximize charge cooling effects of the water injection while minimizing charge dilution effects. As still another example, direct fuel injection into the engine cylinders may provide additional in-cylinder charge cooling. The fuel injectors to be employed may be selected based on intake manifold cooling demand, dilution demand, and charge cooling demands relative to one another. As an example, when there is a higher demand for manifold cooling, a larger portion of the total fuel amount may be delivered as manifold injection via the CFI. In another example, when there is a higher demand for charge cooling, a larger portion of the total fuel amount may be delivered as direct injection via the DI. In still another example, when there is a higher demand for charge dilution, a larger portion of the total fuel amount may be delivered as port injection via the PFI. Two or more fuel injectors (e.g., all the fuel injectors) may be selected to simultaneously inject at portion of the total fuel at different locations of the engine.

Determining the initial fueling further includes, at 307, determining a fuel split ratio including the portion of total fuel delivered via each of the selected injectors. The split ratio may be determined based on engine operating conditions including charge cooling demand relative to dilution demand, as discussed above. In addition, the split ratio may be based on temperature conditions. As an example, if the intake manifold temperature, as estimated via a manifold charge temperature sensor, is above an upper threshold temperature, manifold cooling may be desired and a higher portion of the total fuel may be manifold injected while a remainder of the total fuel is port and/or direct injected. In comparison, when the manifold temperature is below a lower threshold, manifold cooling may no longer be desired and manifold fuel injection may be disabled. In another example, when the engine dilution demand is higher than a threshold, a higher portion of the total fuel may be port injected while a remainder of the total fuel is manifold and/or direct injected.

Determining the split ratio may also include determining a number of fuel injections to deliver the fuel as. For example, each of the direct injected, port injected, and manifold injected fuel amount may be delivered as a single injection (of the determined amount) or as a plurality of injections (totaling the determined amount). As an example, direct injected fuel may be delivered as a single intake stroke injection, a single compression stroke injection, multiple intake stroke injections, multiple compression stroke injections, or a combination of intake stroke and compression stroke injections. In one example, as the amount of fuel to be delivered by any given fuel injector exceeds a threshold amount (such as a threshold based on the pulse-width limit of the injector), the number of injections via the given injector may be increased.

Based on the split ratio, the controller may determine a control signal to send to each of the fuel injector actuators, such as a pulse width signal, based on the engine operating conditions. The controller may make a logical determination (e.g., regarding a pulse-width signal to be sent to each fuel injector) based on logic rules that are a function of torque demand, engine dilution demand, and engine cooling demand. The controller may then send the control signals to the actuators of the corresponding fuel injectors. The controller may also determine a timing of fuel injection from each injector based on the conditions. As an example, based on whether port injection is being used for meeting an engine dilution demand or a charge cooling demand, a timing and direction of fuel injection may be varied. When port injection is used for leveraging dilution benefits, fuel may be injected towards a closed intake valve (such as at TDC of an exhaust stroke) so as to substantially immediately vaporize any injected fuel. In comparison, when port injection is used for leveraging cooling benefits, fuel may be injected away from an open intake valve (such as near BDC of an intake stroke) so as to increase mixing of the injected fuel with the oncoming airflow. As another example, a control signal sent to the actuator of the direct injector may be adjusted based on whether a direct injection is provided as intake stroke injection(s), compression stroke injection (s), or a combination thereof. As such, fuel may be simultaneously injected via two or more injectors or all the injectors. Consequently, there may be a time gap between fuel injections via the plurality of injectors.

At 308, the method includes retrieving measured/sensed manifold charge temperature (MCT) data from a preceding manifold fuel injection event. In particular, a measured change in manifold charge temperature following an immediately precious manifold fuel injection event may be retrieved. The measured change in manifold charge temperature may include a difference between an output of an MCT sensor sensed before the immediately previous manifold injection relative to the output of the MCT sensor sensed following the immediately previous manifold injection. The manifold charge temperature sensor may be positioned in the intake manifold downstream of the manifold fuel injector.

At 310, the method includes estimating a concentration of fuel vapor in the intake manifold. For example, the controller may estimate a fraction of the manifold injected fuel that vaporized following the immediately previous manifold fuel injection based on the measured change in manifold temperature. The controller may further estimate the fraction of manifold injected fuel that condensed on the manifold surface based on the fraction of fuel that vaporized relative to the amount of fuel delivered via the manifold fuel injection. Based on the amount of fuel that vaporized and further based on manifold fuel puddle dynamics, the controller may estimate the amount of fuel vapor present in the manifold. Further, the concentration of fuel vapor in the intake manifold may be estimated as a function of each of a current intake manifold fuel puddle size, an increase in the intake manifold fuel puddle due to the manifold injection, and a decrease in the intake manifold fuel puddle due to fuel vaporization.

At 312, the method includes estimating a temperature of the manifold surface onto which fuel is manifold injected. The temperature may be estimated as function of the sensed manifold charge temperature and further as a function of the charge cooling effect provided by the preceding manifold fuel injection. For example, as the sensed manifold charge temperature decreases and/or as the charge cooling effect provided by the preceding manifold fuel injection increases (an inferred from the amount of fuel that vaporized), the inferred temperature of the manifold surface may be lowered.

As fuel is injected into the intake manifold via the CFI, a part of the fuel may not vaporize and may, instead, condense on the walls of the intake manifold contributing to a manifold fuel puddle. Therefore, the entire amount of manifold injected fuel may not be available for cylinder combustion. Further, based on factors such as the composition of the fuel and engine operating conditions such as intake manifold temperature, temperature of manifold surface, ambient humidity, a portion of fuel from the fuel puddle may vaporize adding to the fuel vapor available for combustion. Further, a portion of the vaporized fuel may condense adding to the fuel puddle volume. Therefore, the size and characteristics of the fuel puddle may change dynamically. These factors may affect the ability of a subsequent manifold fuel injection to provide a desired charge cooling. To compensate for their effect, one or more correction factors may be determined and applied during the determination of subsequent fuel injection schedules. For example, a charge cooling correction factor may be learned to compensate for the charge cooling while a fuel puddle correction factor may be learned to compensate for the fuel puddle dynamics. In some examples, the controller may update the charge cooling correction factor based on the estimated fraction of manifold injected fuel that vaporized while updating the fuel puddle correction factor based on the fraction of manifold injected fuel that condensed on the manifold surface.

At 314, the method includes predicting the charge cooling effect of the scheduled manifold fuel injection (scheduled at 304). The charge cooling effect may be predicted based on each of a concentration of fuel vapor in the intake manifold (as estimated at 310) and a temperature of the manifold surface onto which the fuel is manifold injected (as estimated at 312). The predicted charge cooling effect may be lowered as the concentration of fuel vapor in the intake manifold increases, and as the temperature of the manifold surface decreases (both of which reduce the likelihood of further fuel vaporization). The charge cooling effect may be further predicted based on the measured change in manifold charge temperature following the immediately previous manifold fuel injection.

The controller may calculate a metric indicative of the predicted charge cooling effect. In one example, the metric may include a number of degrees (Celsius) by which the manifold temperature is predicted to drop. In another example, the metric may include a number of degrees of spark retard which would have to be applied if the charge cooling was not provided. In still another example, the metric may include a fuel economy improvement predicted to be provided by the charge cooling (e.g., in brake specific fuel consumption (BSFC) units).

At 316, it may be determined if the predicted charge cooling effect is higher than a threshold. For example, it may be determined if the predicted charge cooling effect is higher than the desired charge cooling. In other words, it may be determined if the manifold conditions will enable the scheduled manifold fuel injection to actually provide the desired charge cooling (or any amount of charge cooling). The controller may then adjust the scheduled ratio of fuel to be delivered to the engine via manifold injection relative to fuel delivered via one or more of port and direct injection based on the predicted charge cooling effect of the manifold injection.

The adjusting includes, at 318, responsive to the predicted charge cooling effect being lower than the threshold, decreasing the ratio of fuel delivered to the engine via manifold injection. In one example, the decreasing includes disabling manifold fuel injection and providing all of the scheduled fuel injection amount via one or more of port and direct injection while not providing any of the scheduled fuel injection amount via manifold injection. The controller may decrease the ratio of fuel delivered to the engine via manifold injection while correspondingly increasing the ratio of fuel delivered via one or more of port and direct injection as the predicted charge cooling effect decreases (e.g., as the predicted charge cooling effect falls below the threshold). In one example, the controller may use a look-up table to determine the manifold fuel injection amount or a factor by while the manifold fuel injection is to be decreased (and the port and/or direct fuel injection is to be increased so as to maintain the exhaust air/fuel ratio at or around a target ratio, such as at or around stoichiometry). A metric indicative of the predicted charge cooling effect, or a difference between the predicted charge cooling effect and the threshold may be used as input and the amount of fuel to be manifold injected may be the output. As another example, the controller may make a logical determination regarding the reduced amount of fuel to be manifold injected based on logic rules that are a function of the predicted charge cooling (relative to the threshold). Based on the reduced manifold fuel injection amount, and the increased port and/or direct fuel injection amounts, the controller may update a control signal corresponding to pulse-width signals to deliver to the selected fuel injectors. For example, the pulse-width to be delivered to an actuator of the manifold injector may be decreased while the pulse-width to be delivered to an actuator of the direct injector may be increased. The method then moves to 322 to deliver fuel according to the updated fuel schedule. For example, the controller may command the updated pulse-width signals to the corresponding fuel injector actuators.

In comparison, responsive to the predicted charge cooling effect being at or above the threshold, at 320, the method includes updating the amount of fuel to be delivered via manifold injection as a function of each of the (updated) charge cooling correction factor and the (updated) fuel puddle correction factor. In addition, the amount of fuel delivered via one or more of port and direct injection may be adjusted based on the updated manifold fuel injection amount so as to maintain an exhaust air-fuel ratio at or around a target ratio (e.g., at or around stoichiometry). Based on the updated manifold fuel injection amount, and the updated port and/or direct fuel injection amounts, the controller may update a control signal corresponding to pulse-width signals to deliver to the selected fuel injectors. For example, the pulse-width to be delivered to an actuator of the manifold injector may be increased to account for manifold injected fuel that may not vaporize, while the pulse-width to be delivered to an actuator of the direct injector and/or the port injectors may be decreased. In alternate examples, the initial fuel injection schedule may be maintained. The method then moves to 322 to deliver fuel according to the updated fuel schedule. For example, the controller may command the updated pulse-width signals to the corresponding fuel injector actuators.

From 322, the method moves to 324 to capture MCT data for the current/scheduled fuel injection event. For example, the controller may measure MCT (via an MCT sensor) before the manifold injection, and then measure MCT after the manifold injection. The difference between the sensed MCT measurements may be used to determine the charge cooling provided in the current manifold fuel injection. The controller may then update the charge cooling and fuel puddle correction factors stored in the controller's memory as a function of the determined charge cooling.

In this way, manifold fuel injection may be leveraged to provide charge cooling benefits only during conditions when the predicted charge cooling effect, based on manifold temperature and fuel puddle conditions, is significant. This allows manifold fuel injection to be used more judiciously.

Figure 4:
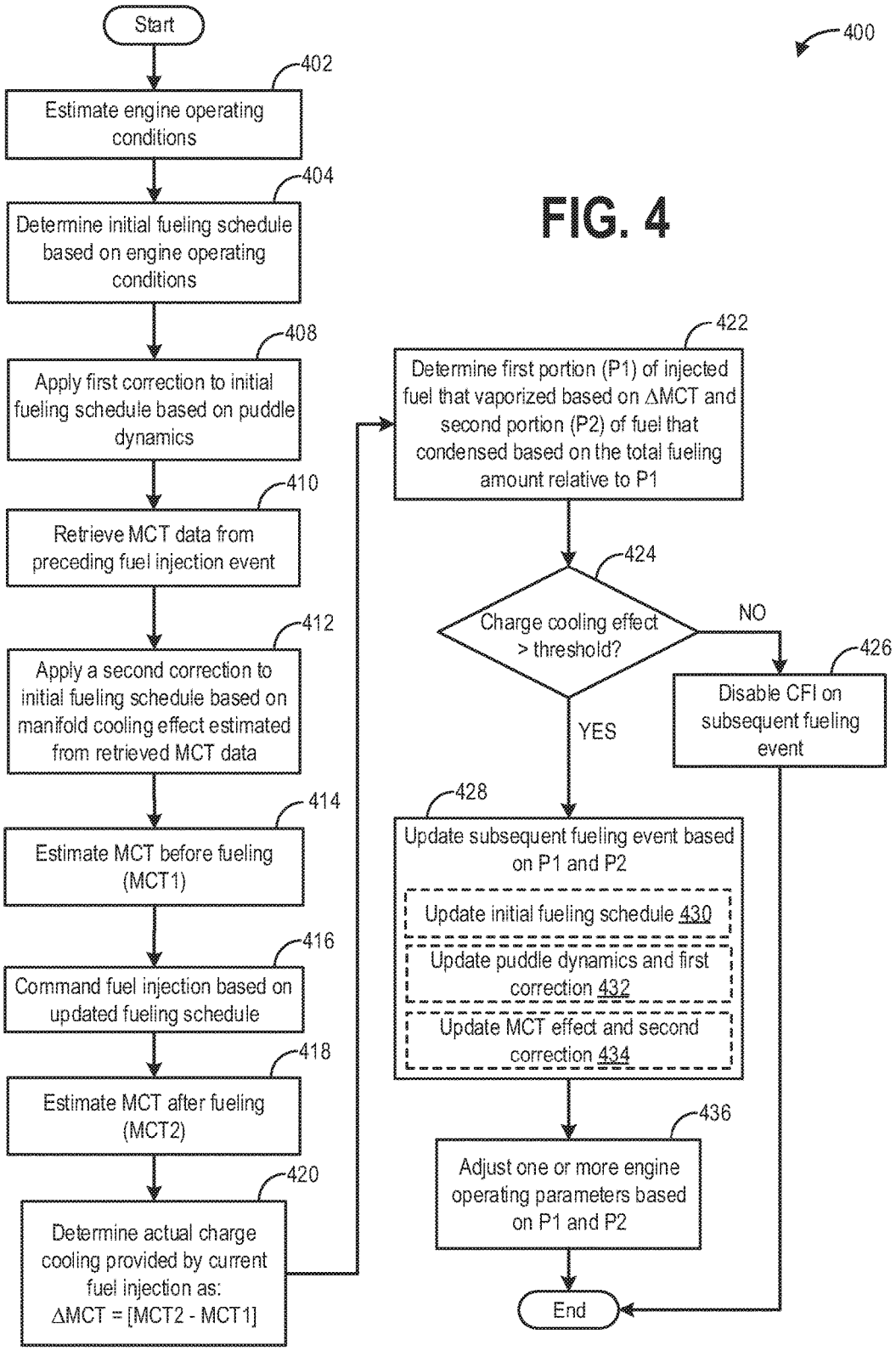
FIG. 4 shows a flow chart illustrating an example method for adjusting a fuel injection schedule based on feedback from a manifold charge temperature sensor.

Turning now to FIG. 4, another example method 400 is shown for adjusting manifold fueling based on feedback from an intake manifold temperature sensor. The method enables the effects of manifold fuel injection to be better leveraged.

At 402, engine operating conditions may be estimated and/or measured. Conditions assessed may include, for example, driver demand, engine temperature, engine load, engine speed, manifold charge temperature, exhaust temperature, ambient conditions including ambient temperature, pressure, and humidity, manifold pressure and flow, boost pressure, exhaust air/fuel ratio, etc.

At 404, an initial fueling schedule may be determined based on the engine operating conditions, torque demand, dilution demand, and engine cooling demand. The fueling schedule may be further based on the transient fuel compensation history of the cylinders. As elaborated at FIG. 3, the controller may determine a total amount of fuel to be injected to meet the engine torque demand, such as a via a look-up table that uses torque demand as input and provides the total amount of fuel to be injected as output. The total amount of fuel to be injected may be injected via one or more of a direct injector (such as DI 47 in FIG. 1), a port injector (such as PFI 48 in FIG. 1), and a central fuel injector (such as CFI 46 in FIG. 1). The controller may also select fuel injection locations and one or more fuel injectors for injecting the fuel at the selected locations. For example, during higher demand for manifold cooling, fuel delivery via the CFI may be selected. In another example, during higher demand for charge cooling, fuel delivery via the DI may be selected while during a higher demand for dilution, fuel delivery via PFI may be selected.

The controller may also determine a fuel split ratio, including the amount of fuel to be delivered via each injector, based on engine operating conditions. In one example, if the intake manifold temperature is above an upper threshold temperature, manifold cooling and/or charge cooling may be desired and a higher percentage of fuel may be injected via the CFI compared to the percentage of fuel injected via the PFI and DI, combined. In another example, if the engine dilution demand is higher than a threshold, a higher percentage of fuel may be injected via the PFI compared to the percentage of fuel injected via the CFI and DI, combined. In a further example, when the engine intake manifold temperature is below a lower threshold temperature, charge cooling may no longer be desired and fuel injection via CFI may be disabled. The controller may determine a control signal to send to each of the fuel injector actuators, such as a pulse-width signal, based on the engine operating conditions.

As fuel is injected to the intake manifold via the CFI, a part of the fuel may not vaporize and may condense on the walls of the intake manifold forming a fuel puddle. Therefore, the entire amount of fuel injected may not be available for combustion which may adversely affect engine performance and emissions quality. Also, based on factors such as composition of the fuel and engine operating conditions such as intake manifold temperature, ambient humidity, a portion of fuel from the fuel puddle may vaporize adding to the fuel vapor available for combustion. Further, a portion of the vaporized fuel may condense adding to the fuel puddle volume. Therefore, the size of the fuel puddle may change dynamically. At 408, a first correction (e.g., via a first fuel puddle correction factor) may be applied to the determined initial fueling schedule to account for the manifold fuel puddle dynamics. The fueling schedule may be adjusted to modify the total amount of fuel delivered as well as the fuel split between the injectors.

The fuel puddle may comprise one or more components such as ethanol, iso-propane, n-decane, etc., based on the composition of the injected fuel. In order to determine the amount of fuel vaporizing from the fuel puddle, the controller may identify the components of the fuel and determine the mass fractions of each components. Once the mass fractions of the fuel puddle components are determined, vapor pressure of each component may be estimated. In one example, the controller may use a look-up table to determine vapor pressure corresponding to the mass fraction of each component. Based on the mass fraction and vapor pressure of each component, the controller may determine the manifold fuel puddle dynamics such as the amount of fuel vaporizing into the manifold from the fuel puddle and the amount of fuel condensing from the manifold into the fuel puddle, thereby adding to the puddle mass. In the first correction, the fueling schedule may be updated based on the changes in puddle size and composition during the fueling. In one example, as the fuel puddle size decreases, the manifold fuel injection amount may be increased (while the port and direct injection amounts are decreased) to account for fuel that may be lost from the manifold injection to replenish the fuel puddle. In another example, as the fuel puddle size increases, the manifold fuel injection amount may be decreased (while the port and direct injection amounts are increased) to account for the additional fuel vapors that are expected to be generated in the manifold from the existing fuel puddle.

At 410, the controller may retrieve manifold charge temperature data estimated via a manifold charge temperature sensor before and after the (immediately) previous fueling event when at least a part of the fuel was delivered via manifold injection. As the fuel vaporizes, heat is absorbed from the walls of the intake manifold which cools the intake manifold. Based on change in intake manifold temperature before and after the fueling, the controller may estimate the cooling effect achieved after manifold fuel injection. The fraction of fuel that has vaporized and the fraction of fuel that has condensed following the previous fueling event may be estimated based on the cooling effect. The details of the estimation of the fuel fraction that vaporizes and the fraction of fuel that has condensed after a fueling event is elaborated at 414 to 422.

At 412, a second correction may be applied to the fueling schedule based on a feedback loop taking into account the charge cooling effect of manifold injected fuel, as estimated from the retrieved MCT data. In the second correction, the amount of fuel to be manifold injected may be adjusted to compensate for the fraction of fuel that may condense (and therefore not be available for combustion). The fueling schedule for the PFI and DI fuel fractions may be correspondingly adjusted in order to maintain a target air-fuel ratio. In this way, in the first correction, fuel puddle dynamics are taken into account and in the second correction, fuel volatility and charge cooling effects are taken into account to compute an updated fueling schedule. By injecting the updated amount of fuel to provide a desired degree of charge cooling, knock incidence may be reduced and the reliance on spark timing retard for knock control is also reduced. Consequently, fuel economy is improved.

At 414, before the current fuel injection is initiated, a first manifold charge temperature (MCT1) may be sensed via a manifold air temperature sensor. At 416, the controller may command a pulse-width signal to the selected fuel injectors to deliver fuel in accordance with the updated fueling schedule. One or more of the CFI, the DI, and the PFI may be actuated to inject determined fractions of the total amount of fuel. At 418, after the fueling event is completed, the manifold charge temperature (MCT2) may be sensed again via the manifold air temperature sensor. After fuel injection into the intake manifold via the CFI, a first portion of the injected fuel may absorb heat from the manifold walls as it vaporizes. A second (remaining) portion of fuel may not vaporize and may add to an existing fuel puddle in the intake manifold. Absorption of heat energy from the intake manifold (by the fuel) causes a manifold cooling effect and there is a corresponding drop in manifold temperature.

At 420, the difference (ΔMCT) between MCT measured before and after the fueling event may be determined in accordance with Equation 1 as:

$$\Delta MCT = MCT1 - MCT2 \quad (1)$$

wherein ΔMCT denotes the drop in manifold temperature due to heat absorbed for fuel vaporization. The controller may then estimate the cooling effect achieved after fuel injection based on the difference.

At 422, a first portion (P1) of manifold injected fuel that vaporized (causing the charge cooling effect) may be estimated as a function of ΔMCT, as per Equation 2:

$$P1 = f(\Delta MCT) \quad (2)$$

The first portion P1 increases as the value of ΔMCT increases, such as when a higher drop in manifold temperature is achieved following manifold fuel injection. A second (remaining) portion of fuel (P2) that condensed on the intake manifold (such as on manifold walls) may be estimated based on the total volume of fuel injected (F1) via CFI and the first portion of fuel P1 (vaporized) as per Equation 3 as:

$$P2 = F1 - P1 \quad (3)$$

In addition, a size of the manifold fuel puddle may be updated (e.g., increased) based on the second portion of fuel, P2.

At 424, the routine includes determining if the charge cooling effect is higher than a threshold. The threshold may be a function of the second portion of fuel (P2) that condensed on the manifold walls, manifold temperature, and charge air temperature. As such if a higher portion of fuel injected via the CFI is condensed, further CFI fuel injection may not be desired. If it is determined that the charge cooling effect is lower than a threshold, at 426, manifold fuel injection may be disabled for at least the immediately subsequent fueling event. Also, if the charge air temperature (and/or manifold temperature) is lower than a threshold temperature, further charge cooling may not be desired and manifold fueling may be reduced or disabled.

If it is determined that the charge cooling effect is higher than the threshold, at 428, the fueling schedule of the immediately subsequent fueling event may be updated based on the first portion of fuel (P1) that has vaporized and the second portion of fuel (P2) that has condensed. At 430, the initial fueling schedule, including amount of fuel injected and/or timing of fuel injection, may be adjusted taking into account the first and second portions of fuel P1 and P2. At 432, the manifold fuel puddle dynamics may be updated taking into consideration at least the second portion of fuel (P2), the amount of fuel from the puddle that has vaporized and the amount of fuel that may have condensed from the vaporized state adding to the fuel puddle size. A first correction may be applied to the fueling schedule and the schedule may be adjusted based on the updated fuel dynamics (as elaborated in step 3410). As such, if the size of the fuel puddle increases to above a threshold size, further fuel injection via CFI may be suspended to reduce further growth in fuel puddle size.

At 434, the charge cooling effect achieved after fuel injection (as estimated in step 420) may be updated and a second correction may be applied (as elaborated in step 412) to the fueling schedule in order to compensate for the volume of fuel that did not vaporize after the previous fuel injection. In this way, based on feedback from the manifold air temperature sensor fueling schedule may be effectively adjusted to inject an optimal amount of fuel as desired for combustion and manifold cooling.

At 436, the method may include adjusting one or more engine operating parameters based on the determined vaporized and/or condensed portions P1 and P2. As one example, adjusting one or more engine operating parameters may include adjusting spark timing to compensate for the condensed portion of the fuel. For example, adjusting spark timing may include increasing an amount of spark advance, where the amount of spark advance increases as the condensed portion decreases (or the vaporized portion increases). In another example, throttle position may be adjusted based on the vaporized portion P1 to maintain the desired air fuel ratio. As such, the throttle opening may be increased as P1 increases and the throttle opening may be decreased as P1 decreases. In still another example, as P1 decreases (reducing the charge cooling effect of the fuel injection), the controller may adjust (e.g., increase) an amount of water that is manifold injected via a manifold water injector to meet the deficit in charge cooling.

In this way, following manifold fuel injection, a controller may infer an amount of fuel that vaporized relative to an amount of fuel that condensed on a manifold surface based on a change in manifold temperature following the injection; update each of a fuel puddle correction factor and a charge cooling correction factor based on the inferring; and adjust a subsequent manifold fuel injection based on the updating. The change in manifold temperature may be estimated based on a difference between an output of a manifold charge temperature sensor before the manifold injection relative to the output of the sensor following the manifold injection. The inferring may include estimating the amount of fuel vaporized based on the change in manifold temperature and estimating the amount of fuel condensed based on the amount of fuel vaporized relative to a total amount of fuel delivered via the manifold fuel injection. The controller may adjust an immediately subsequent manifold fuel injection by decreasing manifold fuel injection as the amount of fuel that vaporized decreases relative to the amount of fuel that condensed while one or more of port and direct fuel injection is correspondingly increased. Further, the controller may predict a charge cooling effect of the immediately subsequent manifold injection based on the amount of fuel that vaporized and reduce the amount of fuel delivered in the subsequent manifold injection as the predicted charge cooling effect decreases. In some examples, the controller may adjust an amount of water that is manifold injected via a manifold water injector based on the inferring.

FIG. 5 shows an example map 500 illustrating the charge cooling benefits of a manifold fuel injection. The y-axis shows temperature after charge cooling while the x-axis shows the amount of fuel injected into the manifold via a CFI (CFI fuel mass). Line 502 shows change in charge air temperature as the amount of fuel injected via CFI increases when the initial manifold temperature at the onset of CFI injection is 40° C. Similarly, lines 504, 506, and 508 show change in charge air temperature as the amount of fuel injected via CFI increases when the initial manifold temperature at the onset of CFI injection is 50° C., 60° C., and 70° C., respectively. As shown by lines 502, 504, 506, and 508, as the amount of fuel injection via CFI increases there in a decrease in charge air temperature, the effect more pronounced as the initial manifold temperature decreases. FIG. 5 is a graphical representation of the drop in charge temperature following CFI fueling, as calculated according to Equation 5 below.

FIG. 6 shows an example map 600 illustrating changes in saturation vapor pressure following manifold fuel injection via CFI. The y-axis shows saturation vapor pressure while the x-axis shows the amount of fuel injected via CFI. Line 602 shows change in saturation vapor pressure as the amount of fuel injected via CFI increases when the initial manifold temperature at the onset of CFI injection is 40° C. Similarly, lines 604, 606, and 608 show change in saturation vapor pressure as the amount of fuel injected via CFI increases when the initial manifold temperature at the onset of CFI injection is 50° C., 60° C., and 70° C., respectively. Saturation vapor pressure may be calculated using Equation 4 as:

$$SVP = 10 * \left( \frac{\mathrm{Ka} - \frac{\mathrm{Kb}}{\mathrm{Kc} + (Ti - \Delta T)}}{760} \right) \tag{4}$$

where SVP is the saturation vapor pressure, Ka is Antoine constant A, Kb is Antoine constant B, Kc is Antoine constant C, Ti is the initial temperature at the onset of CFI injection, and ΔT is the delta pressure. ΔT may be calculated using Equation 5 as:

$$\Delta T = \frac{\text{Heat of vaporization}}{\text{air/fuel ratio} * \text{specific heat of air}} \tag{5}$$

where ΔT is the drop in charge temperature following CFI fueling. The air/fuel ratio may be calculated using Equation 6 as:

$$\frac{A}{F} = 100 * \frac{\text{mass of air}}{\text{mass of } CFI \text{ fuel}} \tag{6}$$

where A/F is the air/fuel ratio calculated based on the mass of intake air and the mass of fuel injected via CFI.

FIG. 6 is a graphical representation of the Saturation vapor pressure calculated using Equation 4 above.

FIG. 7 shows an example map 700 illustrating change in saturation fuel pressure following manifold fuel injection via CFI. The y-axis shows saturation fuel pressure while the x-axis shows the amount of fuel injected via CFI. Line 702 shows change in saturation fuel pressure as the amount of fuel injected via CFI increases when the initial temperature at the onset of CFI injection is 40° C. Similarly, lines 704, 706, and 708 show change in saturation fuel pressure as the amount of fuel injected via CFI increases when the initial temperature at the onset of CFI injection is 50° C., 60° C., and 70° C., respectively. FIG. 7 is a graphical representation of the air/fuel ratio change determined by Equation 6 above.

By using a combination of the plots of FIGS. 5-7, an engine controller may determine the maximum amount of CFI fuel that can be vaporized at any given manifold temperature and pressure condition without respect to time. A mass fraction of total fuel that can be delivered via central/manifold fuel injection may be accordingly determined. Remaining mass fractions of fuel to be delivered via direct and/or port injection may be accordingly calculated.

Turning now to FIG. 8, an example map 800 is shown for adjusting the ratio of manifold fuel injection to port or direct injection of fuel based on a predicted charge cooling effect of the manifold fuel injection. Map 800 depicts engine speed at plot 802, an amount of fuel delivered via central (manifold) fuel injection at plot 804, an amount of fuel delivered via port and/or direct fuel injection at plot 806, a fraction of the central injected fuel that vaporized (CFI fuel fraction_vaporized) at plot 808, a remaining fraction of the central injected fuel that condensed in the manifold (CFI fuel fraction_condensed) at plot 810, a manifold fuel puddle state (e.g., size or volume) at plot 812, and MCT (as measured by an MCT sensor at plot 814. For each parameter, the value increases along the y-axis, going upwards. All plots are shown over time along the x-axis.

Prior to t1, the engine is operating at low speed (plot 802). During this time, only charge dilution is required, and no charge cooling is required. In addition, the operator torque demand at this time is lower. To meet the torque demand and the dilution demand, fuel is delivered to the engine via only port injection (plot 806). At this time, no central fuel injection is commanded (plot 804). As a result, MCT remains constant during this time (plot 814). Also, a manifold fuel puddle size (plot 812) remains substantially constant, or decreases slightly as some of the fuel from the puddle is vaporized due to air flowing over the puddle.

At t1, there is an increase in operator torque demand, responsive to which there is an increase in engine speed and load, such as to a mid-high load region. Due to the engine becoming potentially knock limited in this region, charge cooling is required, and manifold injection is enabled to provide the required charge cooling. A split ratio of fuel is determined based on engine operating conditions. Between t1 and t2, a larger portion of the total fuel to be delivered is provided as a manifold fuel injection (plot 804) while a remaining smaller portion of the total fuel to be delivered is provided as one or more of a port and direct fuel injection (plot 806). As a result of the increased manifold injection which produces a charge cooling effect, MCT starts to drop. A larger portion of the manifold injected fuel is vaporized (plot 808), for example, due to higher ambient temperatures (or higher MCT at the time of the manifold fuel injection) while a remaining, smaller portion of the manifold injected fuel condenses into the intake manifold. The condensed fraction contributes to the manifold fuel puddle.

Based on the change in MCT, the updated fuel puddle size, and the charge cooling effect of the fuel that was manifold injected (between t1 and t2), a charge cooling effect of a future manifold injection (scheduled at t2) is predicted. For example, based on the change in MCT, the updated fuel puddle size, and the charge cooling effect of the fuel that was manifold injected, a manifold temperature and fuel vapor concentration may be updated, and these may be used to predict the charge cooling effect of an amount fuel scheduled to be manifold injected at t2. At t2, it may be predicted that the charge cooling effect of the scheduled manifold fuel injection is sufficiently high. Accordingly, between t2 and t3, fuel is injected according to the determined fuel schedule. As the fuel is injected, a large charge cooling effect may occur with a large amount of the injected fuel being vaporized, and the fuel puddle size decreasing due to vaporization of a portion of the fuel puddle.

Based on the change in MCT measured between t2 and t3, the updated fuel puddle size, and the charge cooling effect of the fuel that was manifold injected (between t2 and t3), a charge cooling effect of a future manifold injection (scheduled at t3) is predicted. For example, based on the change in MCT, the updated fuel puddle size, and the charge cooling effect of the fuel that was manifold injected, a manifold temperature and fuel vapor concentration may be updated, and these may be used to predict the charge cooling effect of an amount fuel scheduled to be manifold injected at t3. At t3, it may be predicted that the charge cooling effect of the scheduled manifold fuel injection is not sufficiently high. This may be due to lower charge temperatures hindering further fuel vaporization, as well as higher fuel vapor concentrations in the intake manifold reducing atomization of injected fuel. In addition, it may be predicted based on fuel puddle dynamics that a larger portion of the manifold injected fuel will condense (e.g., to replenish the fuel puddle). Accordingly, after t3, fuel is not injected according to the determined fuel schedule (indicated at dashed lines 805, 807). Instead, the amount of fuel delivered via manifold injection is decreased (relative to initially scheduled amount 805) while the amount of fuel delivered via port or direct injection is increased (relative to initially scheduled amount 807).

In this way, the charge cooling effect of a manifold fuel injection may be better leveraged. By inferring an amount of fuel that has vaporized and contributed to a charge cooling effect of a manifold fuel injection, based on feedback from a manifold temperature sensor following the manifold fuel injection, manifold fuel vapor and temperature conditions may be determined. These, in turn, may be used to more accurately predict the charge cooling effect of a subsequent manifold injection, and better account for manifold fuel puddle dynamics. The technical effect of accurately estimating the amount of fuel that vaporized and contributed to a charge cooling effect is that a subsequent fueling schedule may be effectively adjusted to provide a desired level of manifold cooling. By disabling manifold fuel injection when sufficient charge cooling cannot be provided, manifold fuel injection may be performed more judiciously during conditions when a fuel economy benefit can be provided.

One example method comprises: adjusting a ratio of fuel delivered to an engine via manifold injection relative to fuel delivered via one or more of port and direct injection based on a predicted charge cooling effect of the manifold injection, the charge cooling effect predicted based on each of a concentration of fuel vapor in the intake manifold and a temperature of a manifold surface onto which fuel is manifold injected. In the preceding example, additionally or optionally, the adjusting includes decreasing the ratio of fuel delivered to the engine via manifold injection while correspondingly increasing the ratio of fuel delivered via one or more of port and direct injection as the predicted charge cooling effect decreases. In any or all of the preceding examples, additionally or optionally, the predicted charge cooling effect is lowered as the concentration of fuel vapor in the intake manifold increases and as the temperature of the manifold surface decreases. In any or all of the preceding examples, additionally or optionally, the concentration of fuel vapor in the intake manifold is estimated as a function of each of a current intake manifold fuel puddle, an increase in the intake manifold fuel puddle due to the manifold injection, and a decrease in the intake manifold fuel puddle due to fuel vaporization. In any or all of the preceding examples, additionally or optionally, the adjusting includes, when the predicted charge cooling effect is higher than a threshold, updating an amount of fuel delivered via manifold injection as a function of each of a charge cooling correction factor and a fuel puddle correction factor. In any or all of the preceding examples, additionally or optionally, the charge cooling effect is further predicted based on a measured change in manifold charge temperature following an immediately previous manifold fuel injection. In any or all of the preceding examples, additionally or optionally, the measured change in manifold charge temperature includes a difference between an output of a manifold charge temperature sensor before the immediately previous manifold injection relative to the output of the sensor following the immediately previous manifold injection, the manifold charge temperature sensor positioned in the intake manifold downstream of a manifold fuel injector. In any or all of the preceding examples, additionally or optionally, the method further comprises, following the immediately previous manifold fuel injection, estimating a fraction of manifold injected fuel that vaporized based on the measured change in manifold temperature and estimating the fraction of manifold injected fuel that condensed on the manifold surface based on the fraction of fuel that vaporized relative to the amount of fuel delivered via the manifold fuel injection. In any or all of the preceding examples, additionally or optionally, the method further comprises updating the charge cooling correction factor based on the estimated fraction of manifold injected fuel that vaporized, and updating the fuel puddle correction factor based on the fraction of manifold injected fuel that condensed on the manifold surface. In any or all of the preceding examples, additionally or optionally, the adjusting further includes updating the amount of fuel delivered via one or more of port and direct injection to maintain an exhaust air-fuel ratio at or around a target ratio.

Another example method for an engine comprises: following manifold fuel injection, inferring an amount of fuel that vaporized relative to an amount of fuel that condensed on a manifold surface based on a change in manifold temperature following the injection; updating each of a fuel puddle correction factor and a charge cooling correction factor based on the inferring; and adjusting a subsequent manifold fuel injection based on the updating. In any or all of the preceding examples, additionally or optionally, the change in manifold temperature is estimated based on a difference between an output of a manifold charge temperature sensor before the manifold injection relative to the output of the sensor following the manifold injection. In any or all of the preceding examples, additionally or optionally, the inferring includes estimating the amount of fuel vaporized based on the change in manifold temperature and estimating the amount of fuel condensed based on the amount of fuel vaporized relative to a total amount of fuel delivered via the manifold fuel injection. In any or all of the preceding examples, additionally or optionally, adjusting the subsequent fuel injection includes adjusting an immediately subsequent manifold fuel injection, wherein manifold fuel injection is decreased while one or more of port and direct fuel injection is correspondingly increased as the amount of fuel that vaporized decreases relative to the amount of fuel that condensed. In any or all of the preceding examples, additionally or optionally, the adjusting further includes predicting a charge cooling effect of the immediately subsequent manifold injection based on the amount of fuel that vaporized and reducing the amount of fuel delivered in the subsequent manifold injection as the predicted charge cooling effect decreases. In any or all of the preceding examples, additionally or optionally, the method further comprises adjusting an amount of water that is manifold injected via a manifold water injector based on the inferring.

Another example engine system comprise: a manifold injector for injecting fuel into an intake manifold; a port injector for injecting fuel into an intake port; a direct injector for injecting fuel directly into an engine cylinder; a temperature sensor coupled to the intake manifold; and a controller with computer readable instructions for: following a first fuel injection event including manifold fuel injection, updating each of a fuel puddle correction factor and a charge cooling correction factor based on an amount of fuel vaporized, the amount of fuel vaporized based on a change in manifold temperature following the manifold fuel injection; and during a second fuel injection event immediately following the first fuel injection event, estimating an initial fuel injection ratio including manifold fuel injection and one or more of the port and direct fuel injection; predicting a charge cooling effect of the manifold fuel injection based on each of a concentration of fuel vapor in the intake manifold and a temperature of a manifold surface; and if the predicted charge cooling effect is higher than a threshold, updating the initial fuel injection ratio to increase the manifold fuel injection as a function of each of the fuel puddle correction factor and charge cooling correction factor, and injecting fuel according to the updated fuel injection ratio. In any or all of the preceding examples, additionally or optionally, the updating further includes decreasing one or more of the port and direct fuel injection based on the increase in manifold fuel injection to maintain exhaust air-fuel ratio at a target ratio. In any or all of the preceding examples, additionally or optionally, the controller includes further instructions for, if the predicted charge cooling effect is lower than the threshold, updating the initial fuel injection ratio to decrease the manifold fuel injection. In any or all of the preceding examples, additionally or optionally, the concentration of fuel vapor in the intake manifold is estimated based on the fuel puddle correction factor, wherein the temperature of the manifold surface is estimated based on the charge cooling correction factor, and wherein the predicted charge cooling effect is increased as the concentration of fuel vapor in the intake manifold decreases and the temperature of the manifold surface increases.

In a further representation, a method for an engine comprises: injecting an amount of fuel into an intake manifold via a central fuel injector; inferring evaporation of a first portion of the fuel based on a change in manifold temperature following the injecting; inferring condensation of a second, remaining portion of the fuel based on the injection amount and the first portion; and adjusting a pulse width commanded to the injector during a subsequent fuel injection based on the first portion relative to the second portion. In any or all of the preceding examples, additionally or optionally, the change in manifold temperature following the injecting is a difference in manifold temperature as estimated via a MCT sensor from before the injecting to a duration after the injecting, wherein the duration is based on an estimated amount of time for the injected amount of fuel to vaporize. In any or all of the preceding examples, additionally or optionally, adjusting the fueling schedule includes a first adjustment based on the second portion of the fuel creating a fuel puddle and a second adjustment based on the first portion of fuel. In any or all of the preceding examples, additionally or optionally, the method further comprises adjusting a pulse width commanded to the injector during a subsequent fuel injection based on the first portion relative to the second portion. In any or all of the preceding examples, additionally or optionally, the method further comprises adjusting a first engine parameter responsive to the first portion and adjusting a second, different engine parameter responsive to the second portion.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine operating method, comprising:

via a controller, adjusting a ratio of fuel delivered to an engine via manifold injection relative to fuel delivered to the engine via port and direct injectors based on a predicted charge cooling effect of the manifold injection, the charge cooling effect predicted based on each of a concentration of fuel vapor in an intake manifold, a temperature of a manifold surface onto which fuel is manifold injected, and an air charge temperature via the controller.

2. The method of claim 1, wherein the adjusting includes decreasing the ratio of fuel delivered to the engine via manifold injection while correspondingly increasing the ratio of fuel delivered via the port and direct injectors as the predicted charge cooling effect decreases via the controller.

3. The method of claim 1, wherein the predicted charge cooling effect is lowered via the controller as the concentration of fuel vapor in the intake manifold increases and as the temperature of the manifold surface or the air charge temperature decreases.

4. The method of claim 3, wherein the concentration of fuel vapor in the intake manifold is estimated via the controller as a function of each of a current intake manifold fuel puddle, an increase in the intake manifold fuel puddle due to the manifold injection, and a decrease in the intake manifold fuel puddle due to fuel vaporization.

5. The method of claim 1, wherein the adjusting includes, when the predicted charge cooling effect is higher than a threshold, updating an amount of fuel delivered via manifold injection as a function of each of a charge cooling correction factor and a fuel puddle correction factor via the controller.

6. The method of claim 5, wherein the charge cooling effect is further predicted via the controller based on a measured change in manifold charge temperature following an immediately previous manifold fuel injection.

7. The method of claim 6, wherein the measured change in manifold charge temperature includes a difference between an output of a manifold charge temperature sensor before the immediately previous manifold injection relative to the output of the manifold charge temperature sensor following the immediately previous manifold injection, the manifold charge temperature sensor positioned in the intake manifold downstream of a manifold fuel injector.

8. The method of claim 6, further comprising, following the immediately previous manifold fuel injection, estimating a fraction of manifold injected fuel that vaporized based on the measured change in manifold temperature via the controller and estimating the fraction of manifold injected fuel that condensed on the manifold surface via the controller based on the fraction of manifold injected fuel that vaporized relative to the amount of fuel delivered via the manifold fuel injection.

9. The method of claim 8, further comprising updating the charge cooling correction factor via the controller based on the estimated fraction of manifold injected fuel that vaporized, and updating the fuel puddle correction factor via the controller based on the fraction of manifold injected fuel that condensed on the manifold surface.

10. The method of claim 5, wherein the adjusting further includes updating the amount of fuel delivered via the port and direct injectors to maintain an exhaust air-fuel ratio at or around a target ratio via the controller.

11. An engine operating method for an engine, comprising:

following manifold fuel injection, inferring an amount of fuel that vaporized relative to an amount of fuel that condensed on a manifold surface based on a change in manifold temperature via a controller following the manifold fuel injection;

updating each of a fuel puddle correction factor and a charge cooling correction factor based on the inferring via the controller; and adjusting a subsequent manifold fuel injection based on the updating via the controller.

12. The method of claim 11, wherein the change in manifold temperature is estimated via the controller based on a difference between an output of a manifold charge temperature sensor before the manifold fuel injection relative to an output of the manifold charge temperature sensor following the manifold fuel injection.

13. The method of claim 11, wherein the inferring includes estimating the amount of fuel vaporized via the controller based on the change in manifold temperature and estimating the amount of fuel condensed based on the amount of fuel vaporized relative to a total amount of fuel delivered via the manifold fuel injection.

14. The method of claim 13, wherein adjusting the subsequent manifold fuel injection includes adjusting an immediately subsequent manifold fuel injection via the controller, and wherein manifold fuel injection is decreased while one or more of port and direct fuel injection is correspondingly increased as the amount of fuel that vaporized decreases relative to the amount of fuel that condensed via the controller.

15. The method of claim 14, wherein the adjusting further includes predicting a charge cooling effect of the immediately subsequent manifold fuel injection based on the amount of fuel that vaporized and reducing the amount of fuel delivered in the subsequent manifold fuel injection as the predicted charge cooling effect decreases via the controller.

16. The method of claim 11, further comprising adjusting an amount of water that is manifold injected via a manifold water injector based on the inferring via the controller.

17. An engine system, comprising:

a manifold injector for injecting fuel into an intake manifold;

a port injector for injecting fuel into an intake port;

a direct injector for injecting fuel directly into an engine cylinder;

a temperature sensor coupled to the intake manifold; and a controller with computer readable instructions for:

following a first fuel injection event including manifold fuel injection, updating each of a fuel puddle correction factor and a charge cooling correction factor based on an amount of fuel vaporized, the amount of fuel vaporized based on a change in manifold temperature following the manifold fuel injection; and during a second fuel injection event immediately following the first fuel injection event, estimating an initial fuel injection ratio including manifold fuel injection and one or more of the port and direct fuel injection;

predicting a charge cooling effect of the manifold fuel injection based on each of a concentration of fuel vapor in the intake manifold and a temperature of a manifold surface; and if the predicted charge cooling effect is higher than a threshold, updating the initial fuel injection ratio to increase the manifold fuel injection as a function of each of the fuel puddle correction factor and the charge cooling correction factor, and injecting fuel according to the updated fuel injection ratio.

18. The system of claim 17, wherein the updating further includes decreasing one or more of the port and direct fuel injection based on the increase in manifold fuel injection to maintain exhaust air-fuel ratio at a target ratio.

19. The system of claim 17, wherein the controller includes further instructions for:

if the predicted charge cooling effect is lower than the threshold, updating the initial fuel injection ratio to decrease the manifold fuel injection.

20. The system of claim 17, wherein the concentration of fuel vapor in the intake manifold is estimated based on the fuel puddle correction factor, wherein the temperature of the manifold surface is estimated based on the charge cooling correction factor, and wherein the predicted charge cooling effect is increased as the concentration of fuel vapor in the intake manifold decreases and the temperature of the manifold surface increases.

* * * * *